US005725121A

United States Patent [19]

Gianpaolo

[11] Patent Number: 5,725,121

[45] Date of Patent: Mar. 10, 1998

[54] CLOSURE FOR CONTAINERS OF LIQUID, GRANULAR OR POWDERY PRODUCTS

[75] Inventor: Belloli Gianpaolo, Pianoro, Italy

[73] Assignee: Catta 27 S.R.L., Crespellano, Italy

[21] Appl. No.: 673,683

[22] Filed: Jun. 25, 1996

[30] Foreign Application Priority Data

Jun. 27, 1995 [IT] Italy ..... BO95A0321

[51] Int. Cl.[6] ..... B65D 55/16

[52] U.S. Cl. ..... 220/375; 220/784; 220/259; 215/306; 229/125.18

[58] Field of Search ..... 220/375, 306, 220/258, 259, 784, 788, 799; 225/321, 277, 274, 306; 229/125.15, 125.17, 125.18

[56] References Cited

U.S. PATENT DOCUMENTS

| | | | |
|---|---|---|---|
| 2,790,567 | 4/1957 | Lawrence | 220/799 |
| 3,145,872 | 8/1964 | Hayes | 220/375 X |
| 3,152,691 | 10/1964 | Hultgren | 220/799 X |
| 3,282,477 | 11/1966 | Henchert | 220/375 |
| 3,416,688 | 12/1968 | Fanning | 215/306 |
| 3,419,179 | 12/1968 | Deuschle et al. | 220/375 X |
| 3,434,620 | 3/1969 | Laurizio | 220/258 |
| 3,458,080 | 7/1969 | Laurizio | 220/258 |
| 4,653,676 | 3/1987 | Stull | 215/321 X |
| 4,909,434 | 3/1990 | Jones et al. | 229/125.15 |
| 4,964,562 | 10/1990 | Gordon . | |
| 5,065,938 | 11/1991 | Anderson . | |
| 5,108,029 | 4/1992 | Abrams et al. | 229/125.15 X |
| 5,199,635 | 4/1993 | Abrams et al. | 229/125.15 X |
| 5,271,519 | 12/1993 | Adams et al. | 220/375 |
| 5,593,054 | 1/1997 | Glynn | 215/306 X |

FOREIGN PATENT DOCUMENTS

| | | | |
|---|---|---|---|
| 0 342 729 A1 | 4/1989 | European Pat. Off. . | |
| 1032383 | 7/1953 | France | 215/321 |
| 2 233 315 | 9/1991 | United Kingdom . | |
| WO 91/08957 | 6/1991 | WIPO . | |

*Primary Examiner*—Allan N. Shoap
*Assistant Examiner*—Nathan Newhouse
*Attorney, Agent, or Firm*—McAulay Fisher Nissen Goldberg & Kiel, LLP

[57] ABSTRACT

A closure for a container of liquid, granular or powdery products, comprises: a hub defined by a tubular central body, an upper free edge and a base fixed outside the container and peripherally external to a pouring opening; a cap removably matchable to the hub in correspondence to a closed condition of the closure; a sheet element peripherally welded to the upper cage of the hub and removable in correspondence to a condition of first opening of the product packaged inside the container; and mating grooves and recesses fit to join the cap to the hub in correspondence to the closed condition.

3 Claims, 3 Drawing Sheets

CLOSURE FOR CONTAINERS OF LIQUID, GRANULAR OR POWDERY PRODUCTS

BACKGROUND

The present invention concerns the technical field of packaging liquid, granular or powdery products both alimentary and not.

Particularly the present invention refers to a closure fastened to a semi-stiff cardboard container of liquid, granular or powdery products, and more particularly a closure for sealing the pouring opening of the container to save the aroma of the packaged product after the first opening of the container.

DESCRIPTION OF THE PRIOR ART

It is known that currently there are many containers for liquid, granular or powdery products, such as, for drinks or detergents, made by means of semi-stiff sheet material, suitably folded up and welded.

Such containers, generally have a parallelepipedal shape, and at the upper pan are folded and closed by means of a transversal welding of the opposite edges in such a way that the top is almost flat or has two main pitched surfaces sloping toward the external area of the container.

Recently, such containers have been provided with "opening-closing" systems, also called "open and close", fastened to the edges of a pouring opening carried out on the top of such semi-stiff containers.

Such systems mainly are constituted by a cap screwable to a hub previously welded on the edge of the pouring opening. The tightness of the packaged product is so achieved through the tight stop of the inner top of the cap onto the free top of tile hub.

Another known "open and dose" system is based on sticking a tab closing-opening device onto the edge of an opening on the upper top of the container. This device consists era base glued to the container and having a spout fit to facilitate the pouring of the packaged product, a hinged tab removably matchable to said base so as to make a tight closure of the container. The more recent embodiments of these last systems include a covering for the pouring opening using a removable or tearable strip of suitable water-repellent material that is glued on the edges of the same opening in such a way to assure a kind of "manufacturer warranty" and "tightness" for the product packaged inside the container before its initial fruition. This strip lies between the container and the tab of the "open and close" device.

These last "open and close" systems also include sticking the tab device in correspondence to a suitably pre-cut zone of the upper top of the container in such a way that a spike, hinged to the base of the tab device, could be pressed inwardly towards the container so as to pierce the underlying pre-cut zone of the container, and therefore open this latter allowing for discharge of the contained product.

The main drawback of such "open and close" systems is that they are made by using an extremely expensive thermoplastic die and a likewise expensive machine using the same die to carry out such closures. The die, the machine and the plastic material used for such closures significantly affects the price of manufacture of each closure.

Another disadvantage is that such closures are fixed to containers of liquid, granular or powdery products that normally must be quickly consumed because they are "fresh" products such as milk and fruit juices. In fact, once one of such containers is opened for its first fruition it is necessary to consume quickly the remaining packaged product even if the container closure is hermetic. This latter, therefore, requires only an "aroma saving cap" and the common closures, often hermetic, are extremely expensive for use when only the simple aroma-saving function or for insulating temporarily the packaged product from the external environment is desired.

The containers using these closures emphasize this disadvantage because they have both reduced capacity, related to the quantity of packaged product that normally is consumed during the first fruition, and extremely high total cost for the container with the closure, as regards the intrinsic value of the packaged product.

OBJECT OF THE INVENTION

The object of the present invention is to propose a closing-opening device for a container of liquid, granular powdery products able to avoid all the previously exposed drawbacks with the prior art.

The main object is therefore to propose a closure, able to tightly seal the container, fixed hermetically onto the container such that, once the seal is removed, there is allowed a subsequent closure of the container to provide a simple aroma-saving function of the packaged product.

Another object is to propose a closure having a hub fastenable onto the external surface of the container both before its filling and after the product, to be packaged, is already dosed therein.

A further object is to propose a closure able to meet the indispensable hygienic rules for the maintenance of the product packaged inside the container when this latter is both sealed or after it is opened, besides facilitating the pouring of the product From the container.

A further object of the present invention is to propose a closure which provides simple fastening, easy usage, safety tightness and extremely low cost.

SUMMARY OF THE INVENTION

The objects of the invention are achieved by providing a closure for a container of liquid, granular or powdery products, preferably parallelepipedal shaped and provided with a pouring opening, said closure being characterized in that it includes: a hub defined by a tubular central body, an upper free edge and a base fixed, outwardly to the container, peripherally to the pouring opening; a cap removably matchable with the hub in correspondence to a closed condition of the closure; a sheet element peripherally welded to an upper edge of the hub and removable in correspondence to a first opening condition of the product packaged inside the cited container; hooking means fit to maintain joined said cap to said hub in correspondence to the closed condition.

BRIEF DESCRIPTION OF THE DRAWINGS

The characteristic features of the present invention are pointed out in the following description with reference to the enclosed drawings, in which.

DESCRIPTION OF THE PREFERRED EMBODIMENTS

Figure 1:
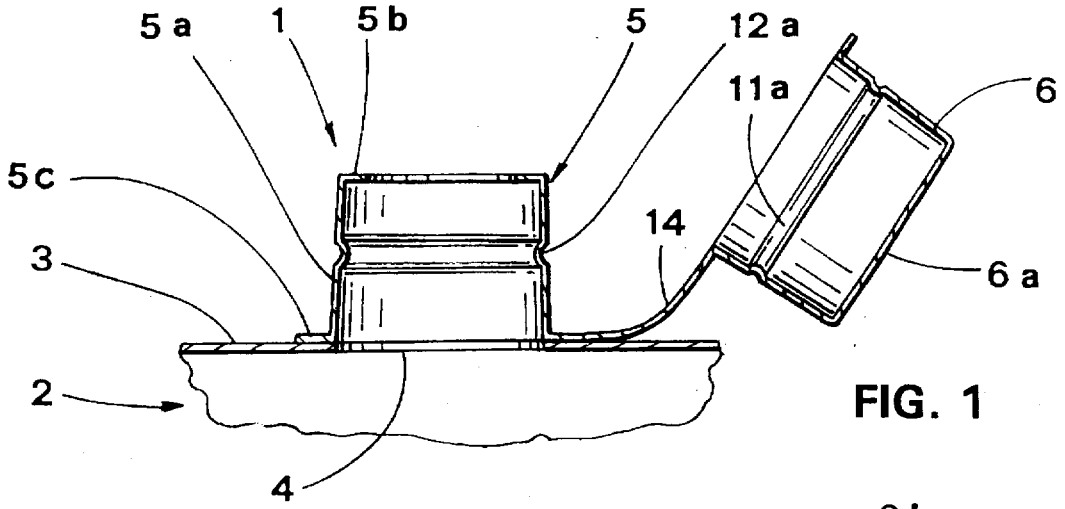
FIG. 1 shows a side sectional view of the closure object of the present invention in the opened configuration.
Figure 2:
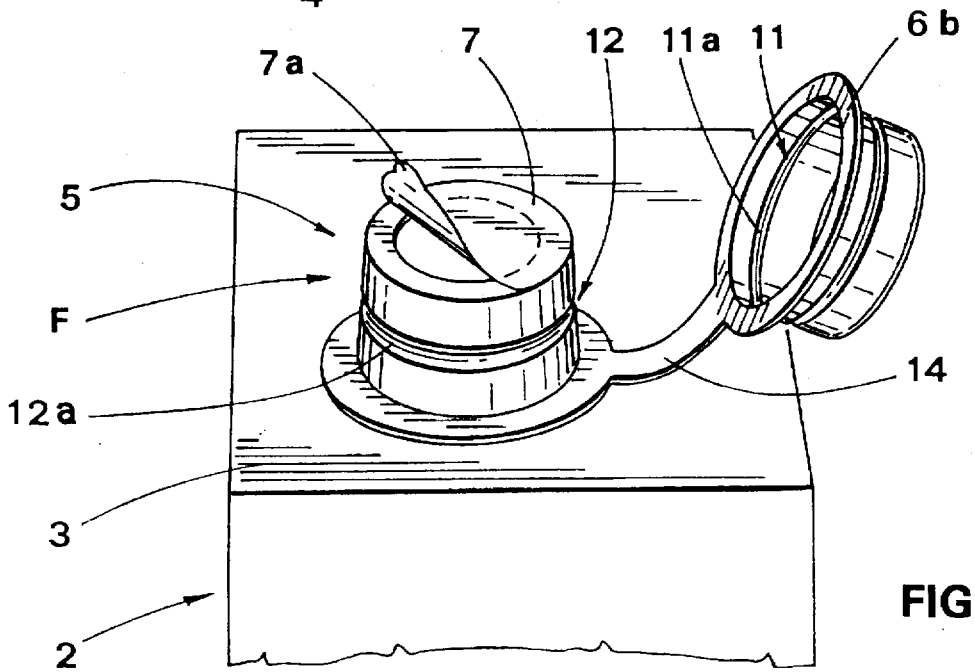
FIG. 2 shows an axonometric view of the opening phase of the seal inside the closure.
Figure 3:
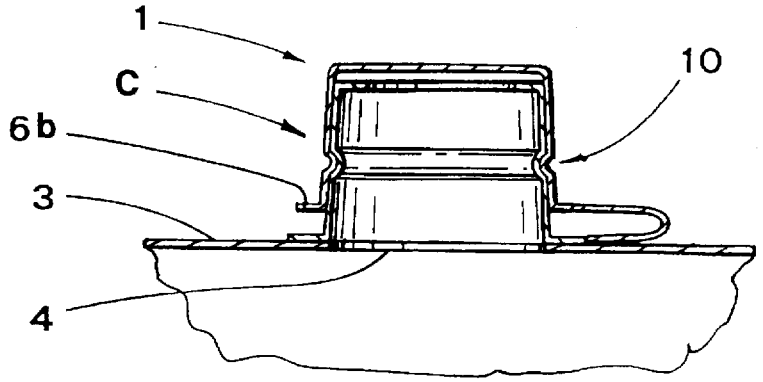
FIG. 3 shows a side sectional view of the closure in the closed configuration.

With reference to FIGS. from 1 to 3, numeral 1 indicates a closure for a container 2 of liquid, granular or powdery products, preferably of parallelepipedal shape with a flat top 3 having a poring opening 4 thereon.

This closure 1 includes a hub 5 having a removable cap 6 hinged thereto, both preferably with cylindrical or frustum of cone shape.

The hub 5 is defined by a tubular central body 5*a*, an upper free edge 5*b* and a base 5*c* welded onto the external wall of the top 3 of the container 2 in such a way to circumscribe entirely the pouring opening 4. This base 5*c* preferably includes a flange outwardly protruding as regards the central body 5*a* and having a flat surface fit to be fixed to the external flat wall of the top 3 of the container 2.

A cap 6, hinged to the base 5*c* of the hub 5 through a flexible tongue 14, is movably joinable to the hub in correspondence to a closed condition C of the closure 1 where the cap 6 covers the hub 5 until the closed bottom 6*a* of the cap 6 stops next to the free upper edge 5*b* of the hub 5. This cap 6 is moreover fit with a protruding external edge 6*b* in correspondence to the opened bottom of this latter so as to facilitate gripping the cap.

The tongue 14 is formed integrally with the cap 6 and the hub 5, but this does not remove the possibility that it might be simply welded to these latter.

A sheet element 7 is peripherally welded hermetically to the upper edge 5*b* of the hub 5. This element 7 has a tongue 7*a* protruding from its side edge by virtue of which the removal of the sheet element from this hub 5 is easer in correspondence to a condition of the first fruition F of the product packaged inside the container 2.

It is moreover desired to use hooking means 10 to maintain joined the cap 6 to the hub 5 in correspondence to the closed condition C of the closure 1.

Such hooking means 10 include first members 11 carried on an inner side surface of the cap 6 and second members 12 carried out on the side wall of the central body 5*a* of the hub 5.

The first members 11 are formed with a ring protrusion 11*a* lying on a plane orthogonal to the axis of the cap 6 at about the middle position between the center line and the open bottom of the cap 6.

The second members 12 include a groove 12*a* lying on a plane orthogonal to the axis of the hub 5 at an almost median position &its central body 5*a*.

This protrusion 11*a* is designed to be inserted with a snap fit into the complementary groove 12*a* in correspondence to the closed condition C of the closure 1.

It is of course proper to consider that such first and second members, 11 and 12, could likewise consist respectively of more recesses and grooves differently conformed, both continuous and discontinuous, without varying from the scope of the present invention.

Figure 4:
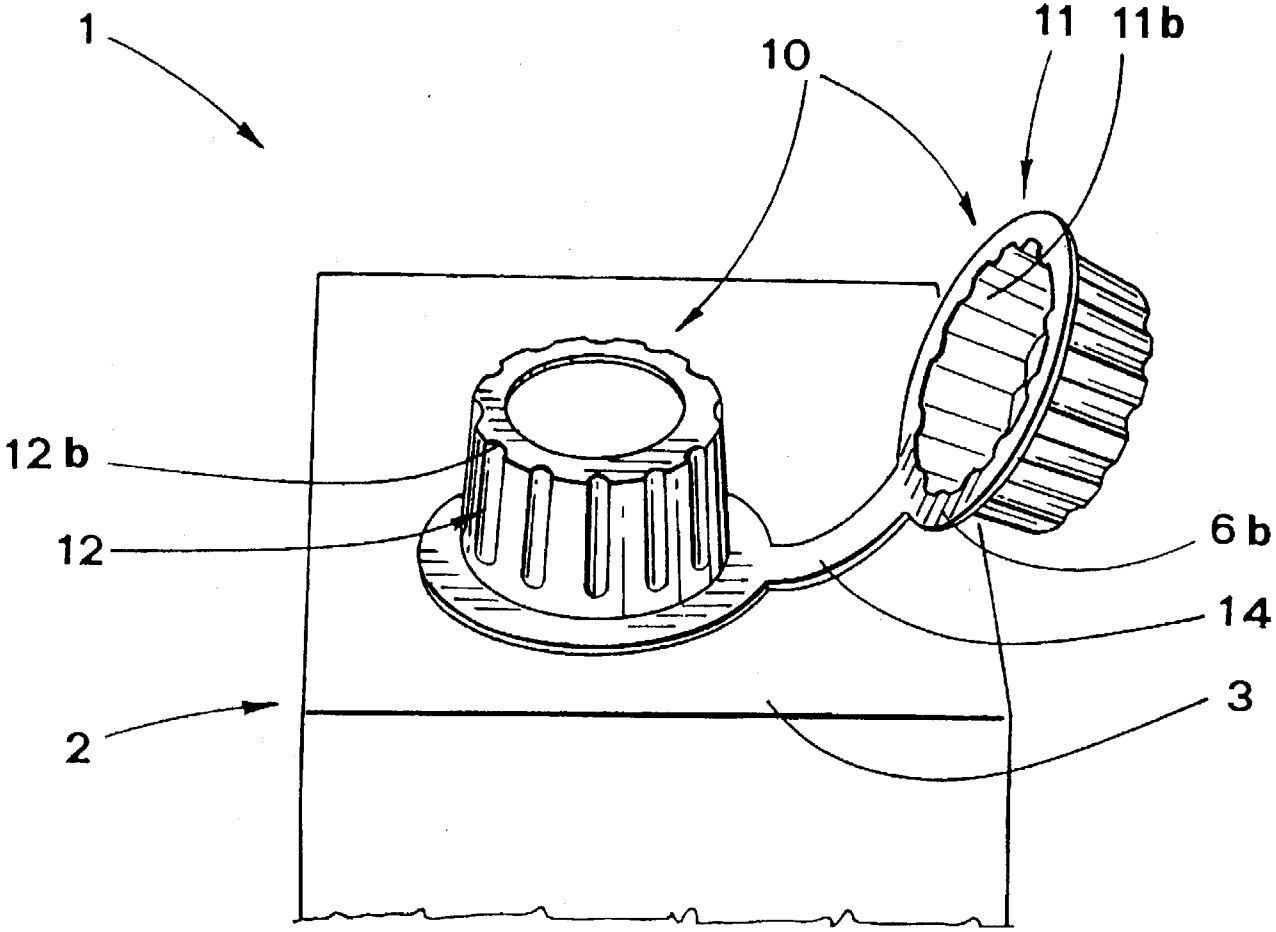
FIG. 4 shows an axonometric view of a second embodiment of the closure.

FIG. 4 shows a second embodiment of such hooking means 10 in which the first members 11 and the second members 12 essentially consist respectively of a series of recesses 11*b* and a series of grooves 12*b* disposed parallel respectively as regards the axis of the cap 6 and the hub 5.

The closure 1 of the aforementioned embodiments is preferably made of a plastic heat-deformable material and therefore, in this ease, it is of the so-called "thermoformed" type.

Figure 5:
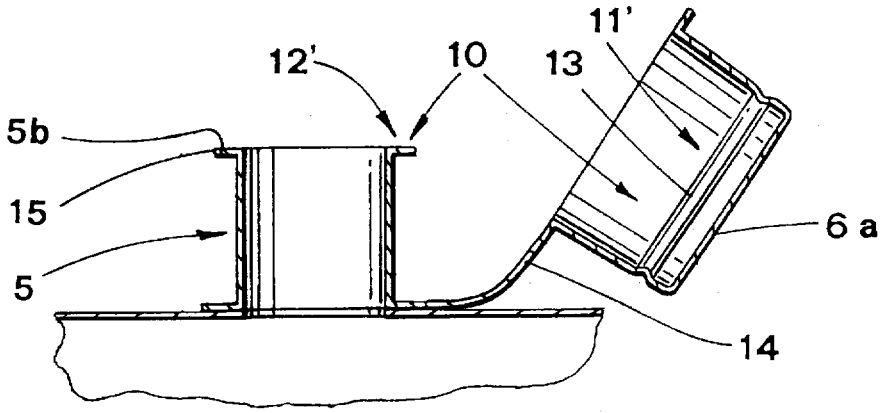
FIG. 5 shows a side sectional view of the closure according to a third embodiment.
Figure 6:
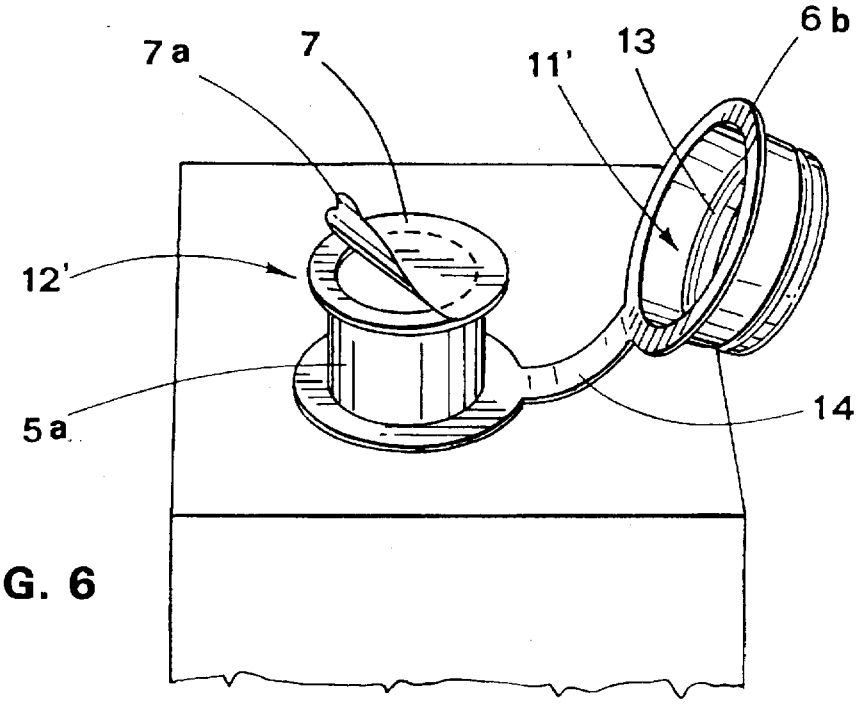
FIG. 6 shows an axonometric view of the opening phase of the seal inside the closure of FIG. 5.
Figure 7:
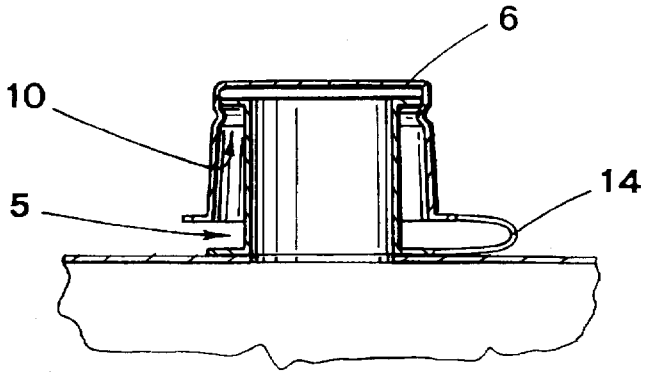
FIG. 7 shows a side sectional view of the closure of FIG. 5 in the closed configuration.

A third embodiment of the closure 1 is shown in FIGS. 5, 6, and 7. Particularly the hub 5 has the upper free edge 5*b* protruding outwardly from the tubular central body 5*a* of the hub itself.

In this embodiment, the hooking means 10 include first and second hooking members, 11' and 12', that respectively consist of a ring pad 13 on the inner wall of the cap 6, disposed in proximity to the dosed bottom 6*a* of the cap, and to the perimetric zone of a protrusion 15, for instance a collar, on the upper edge 5*b* of the hub 5.

The pad 13 is fit to snap over the collar 15 in correspondence to the closed condition C of the closure 1.

This pad 13 can moreover be provided in a discontinuous form or more simply could be made with a pair of ring segments protruding from the inside wall of the cap 6.

It is an important feature of the invention, but not essential, that the closure according to this embodiment is made of plastic extruded material and that therefore the closure is made of a "thermoplastic".

The closure of the above mentioned embodiments, could have a transversal cross-section different from the circular one, for instance it could be square, hexagonal, etc. without varying from the scope of the claimed invention.

The usage of such a closure for containers of liquid, granular or powdery products is extremely simple because, beginning from the closed condition C where the cap 6 is coupled to the relative hub 5, the operator must at first uncouple the cap 6 from the hub 5, then "tears away" the sheet element 7 from this latter to define for the closure 1 the condition of the first fruition F of the product packaged inside the container 2.

Once the operator has poured the packaged product trough the closure 1, this latter could be brought again into the closed condition C by simply "overturning" the cap 6 onto the hub 5 till the first hooking members 11, 11' snap fit, or couple with friction, into the second members 12, 12' so as to make no hermetic closure of the container 1, on the contrary making only an "aroma-seal" closure of the product still packaged inside the container.

This closure 1 is advantageously conformed not only for its usage, but also for its easer fastening to semi-stiff containers of liquid or powdery products.

A direct consequence of the above is the making of simple closures, particularly of the thermoformed type, and therefore of relatively low cost using thermoformable material and processing, with the consequent low cost of each of these closures.

A further feature of the embodiments of the above mentioned closure is that it is possible to pour completely the product packaged inside the container by virtue of the particular conformation of each closure.

The main advantage is therefore to provide a closure initially fit to seal hermetically the container onto which it is fixed and to allow the subsequent closure, after the first fruition, so as to save the aroma of the product still contained therein without having the useless feature of capping again hermetically the container itself.

Another advantage is to provide a closure in which the hub is fastenable onto the outer surface of the container either before its filling or after the product is already dosed therein; by virtue of this hub it is moreover likely to achieve the complete preservation fulfillment of the packaged product.

Another advantage is to provide a closure fit to guarantee the of the hygienic rules necessary for the maintenance of the product packaged inside the container both when this latter is sealed or after it has been opened for the first time.

A further advantage is to provide a closure carried out without expensive apparatuses requiring no extremely sophisticated or customized devices for making the closures.

A further advantage of the invention is to provide a closure of simple making and fastening, easy usage, relatively safe tight fit and extremely lowered cost.

What is claimed is:

1. A closure for a container of liquid, granular or powdery products, provided with a pouring opening, said closure consisting essentially of:

a hub defined by a tubular central body having a frustum of cone shape, an upper free edge and a base fixed outwardly to the container, peripherally to the pouring opening;

a cap removably mateable with the hub in correspondence to a closed condition of the closure and having a downwardly depending skirt, the cap skirt having a corresponding frustum of cone shape, a flexible tongue for hingely connecting the cap and the base of the hub, the tongue integrally formed with the cap and the hub;

a sheet element peripherally welded to an upper edge of the hub and removable in correspondence to a first opening condition for providing access to the product packaged inside the container;

hooking means for maintaining the cap and the hub joined in correspondence to the closed condition, the hooking means including first members on a side inner surface of the cap and second members on a side wall of a central body of the hub, said first and second members being mateable in complementary correspondence to produce the closed condition, and wherein the first members and the second members consist respectfully of a series of recesses and a series of grooves respectively disposed parallel to the tubular central body of the hub, the first members extending on along the substantial length of the skirt, the second members extending from the upper free edge toward the base, and a gap between the lowermost portion of the second members and the base on said hub.

2. Closure according to claim 1, wherein said closure is made of a plastic heat-deformable material.

3. Closure according to claim 1, wherein said closure is made of an extruded plastic material.

* * * * *